United States Patent [19]

Lin

[11] Patent Number: 5,025,828

[45] Date of Patent: Jun. 25, 1991

[54] VALVE ASSEMBLY FOR A PISTON COMPRESSOR

[76] Inventor: Pi-Chu Lin, No. 157-8, Hu-Tzu Nei, Hu-Nei Li, Chia-Yi City, Taiwan

[21] Appl. No.: 550,153

[22] Filed: Jul. 9, 1990

[51] Int. Cl.[5] ..... F04B 21/02

[52] U.S. Cl. ..... 137/512; 251/65; 417/571

[58] Field of Search ..... 137/512, 516.11, 516.13; 251/65; 417/566, 569, 571

[56] References Cited

U.S. PATENT DOCUMENTS

| | | | |
|---|---|---|---|
| 1,700,372 | 1/1929 | Leinert | 137/516.11 X |
| 1,704,513 | 3/1929 | Pfeifer | 137/512 X |
| 2,690,295 | 9/1954 | Rand | 417/571 |
| 3,277,830 | 10/1966 | Kalert, Jr. et al. | 417/571 X |
| 3,409,038 | 11/1968 | Blackford | 251/65 X |
| 3,491,790 | 1/1970 | Sanford | 251/65 X |
| 3,891,000 | 6/1975 | Melnick | 251/65 X |
| 4,304,534 | 12/1981 | Meise et al. | 137/512 X |
| 4,408,967 | 10/1983 | Unger et al. | 417/571 |
| 4,801,250 | 1/1989 | Lammers | 417/571 X |

*Primary Examiner*—John Rivell

*Attorney, Agent, or Firm*—Ostrolenk, Faber, Gerb & Soffen

[57] ABSTRACT

A valve assembly is interposed between the cylinder body and the cylinder cover of a piston compressor in which a piston assembly is provided slidably in the cylinder body. The valve assembly has an inlet passage with an increased-diameter inlet chamber, and an outlet passage with an increased-diameter outlet chamber. When the piston assembly moves away from the valve assembly in a suction stroke, an inlet valve rests on the inlet projections in the inlet chamber so as to enable gas to flow into the cylinder body, while an outlet valve closes the outlet passage, so as to prevent gas from flowing out of the cylinder body. When the piston assembly moves toward the valve assembly in a compression stroke, the inlet valve closes the inlet passage so as to prevent gas from flowing into the cylinder body, while the outlet valve rests on the outlet projections in the outlet chamber so as to enable gas to flow from the cylinder body.

2 Claims, 6 Drawing Sheets

VALVE ASSEMBLY FOR A PISTON COMPRESSOR

BACKGROUND OF THE INVENTION

This invention relates to a valve assembly for a piston compressor, more particularly to a durable and highly efficient valve assembly for a piston compressor which has slidable valves.

Referring to FIGS. 1 and 2, a conventional valve assembly for a piston compressor interconnects a cylinder body 21 and a cylinder cover 22 and includes a generally disc-shaped valve seat member 11, an outer diaphragm 12, an inner diaphragm 13 and a positioning plate 14. The outer diaphragm 12 and the inner diaphragm 13 are flexible and are fastened to the center of the valve seat member 11. An inlet 111 and an outlet 112 are formed through the valve seat member 11. Normally, the inlet 111 and the outlet 112 are respectively closed by the inner diaphragm 13 and the outer diaphragm 12. The positioning plate 14 is also fastened to the center of the valve seat member 11, in such a manner that it presses the outer diaphragm 12 against the valve seat member 11. Because the positioning plate 14 has a curved portion, the outer diaphragm 12 can flex to open the outlet 112 of the valve seat member 11.

When the piston assembly 211 moves away from the valve assembly 11 in a suction stroke, gas outside the cylinder body 21 breaches the seal formed by the inner diaphragm 13 and enters the space between the valve assembly and the piston assembly 211. When the piston assembly 211 moves toward the valve assembly in a compression stroke, gas between the valve assembly and the piston assembly 211 is compressed so as to push and flex the outer diaphragm 12. This flexibility of the outer diaphragm 12 allows gas to be pushed out of the space between the valve assembly and the piston assembly 211. The diaphragms 12 and 13 easily incur elastic fatigue and have the disadvantages of unsatisfactory durability and sealing effects.

SUMMARY OF THE INVENTION

It is therefore the main object of this invention to provide a durable and highly efficient valve assembly for a piston compressor.

According to this invention, a valve assembly is interposed between the cylinder body and the cylinder cover of a piston compressor in which a piston assembly is provided slidably in the cylinder body. The valve assembly has an inlet passage, an outlet passage, an inlet valve to open and close the inlet passage, and an outlet valve to open and close the outlet passage. The inlet passage has an increased-diameter inlet chamber formed in the intermediate portion thereof. Similarly, the outlet passage has an increased-diameter outlet chamber formed in the intermediate portion thereof The inlet chamber includes an outer end wall, an inner end wall positioned between the outer end wall of the inlet chamber and the piston assembly, and several inlet projections extending from the inner end wall of the inlet chamber. The outlet chamber includes an outer end wall, an inner end wall positioned between the outer end wall of the outlet chamber and the piston assembly, and several outlet projections extending from the outer end wall of the outlet chamber. The inlet valve is disposed slidably within the inlet chamber and has a diameter greater than that of the inlet passage, so as to rest on the outer end wall of the inlet chamber in a compression stroke, thereby closing the inlet passage. The outlet valve is disposed slidably within the outlet chamber and has a diameter greater than that of the outlet passage, so as to rest on the inner end wall of the outlet chamber in a suction stroke, thereby closing the outlet passage. The inlet valve rests on the inlet projections during the suction stroke so that gas can flow into the cylinder body through the inlet passage during suction. The outlet valve rests on the outlet projections in the compression stroke so that gas can flow from the cylinder body through the outlet passage during compression. It is difficult to damage the inlet valve or the outlet valve, even if the piston compressor is used for a long period.

Preferably, the inlet valve and the outlet valve are made of a rubber magnet, and the inner and outer end walls of said inlet and outer chambers are made of a metal which can be attracted by a rubber magnet, so as to enhance the sealing effect of the inlet and outlet valves.

In one embodiment, the valve assembly includes a generally disc-shaped valve seat member, an outer retaining plate, an inner retaining plate, a first O-ring and a second O-ring. The valve seat member includes an outer end surface connected securely to the cylinder cover, an inner end surface connected securely to the cylinder body, an axially extending inlet hole formed through the valve seat member and having an increased-diameter end portion formed in the outer end surface of the valve seat member so as to form the inlet chamber, an annular inlet-surrounding groove formed in the outer end surface of the valve seat member around the inlet chamber, an axially extending outlet hole formed through the valve seat member and having an increased-diameter end portion formed in the inner end surface of the valve seat member so a to form the outlet chamber, and an annular outlet-surrounding groove formed in the inner end surface of the valve seat member around the outlet chamber. The outer retaining plate is secured to the outer end surface of the valve seat member so as to retain the inlet valve within the inlet chamber, and has an inlet hole formed through the outer retaining plate to communicate with the inlet hole of the valve seat member, and an outlet hole formed through the outer retaining plate to communicate with the outlet hole of the valve seat member. The inner retaining plate is secured to the inner end surface of the valve seat member so as to retain the outlet valve within the outlet chamber, and has an inlet hole formed through the inner retaining plate to communicate with the inlet hole of the valve seat member, an outlet hole formed through the inner retaining plate to communicate with the outlet hole of the valve seat member. The inlet holes of the valve seat member, the outer retaining plate and the inner retaining plate constitute together the inlet passage, while the outlet holes of the valve seat member, the outer retaining plate and the inner retaining plate constitute together the outlet passage. The first O-ring is received within the inlet-surrounding groove of the valve seat member so as to establish an air-tight seal between the valve seat member and the outer retaining plate around the inlet chamber. The second O-ring is received within the outlet-surrounding groove of the valve seat member so as to establish an air-tight seal between the valve seat member and the inner retaining plate around the outlet chamber.

In another embodiment, the valve assembly includes a generally disc-shaped valve seat member, an outer retaining plate, a first O-ring and a second O-ring. The valve seat member includes an outer end surface connected securely to the cylinder cover, an inner end surface connected securely to the cylinder body, an axially extending inlet hole formed through the valve seat member and having an increased-diameter end portion formed in the outer end surface of the valve seat member so as to form the inlet chamber, an annular inlet-surrounding groove formed in the outer end surface of the valve seat member around the inlet chamber, an axially extending outlet hole formed through the valve seat member and having an increased-diameter end portion formed in the outer end surface of the valve seat member so as to form the outlet chamber, and an annular outlet-surrounding groove formed in the outer end surface of the valve seat member around the outlet chamber. The outer retaining plate is secured to the outer end surface of the valve seat member in such a way that it retains the inlet and outlet valves within their respective chambers, and has an inlet hole formed through the outer retaining plate to communicate with the inlet hole of the valve seat member, and an outlet hole formed through the outer retaining plate to communicate with the outlet hole of the valve seat member. The first O-ring is received within the inlet-surrounding groove of the valve seat member so as to establish an air-tight seal between the valve seat member and the outer retaining plate around the inlet chamber. The second O-ring is received within the outlet-surrounding groove of the valve seat member so as to establish an air-tight seal between the valve seat member and the outer retaining plate around the outlet chamber.

BRIEF DESCRIPTION OF THE DRAWING

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
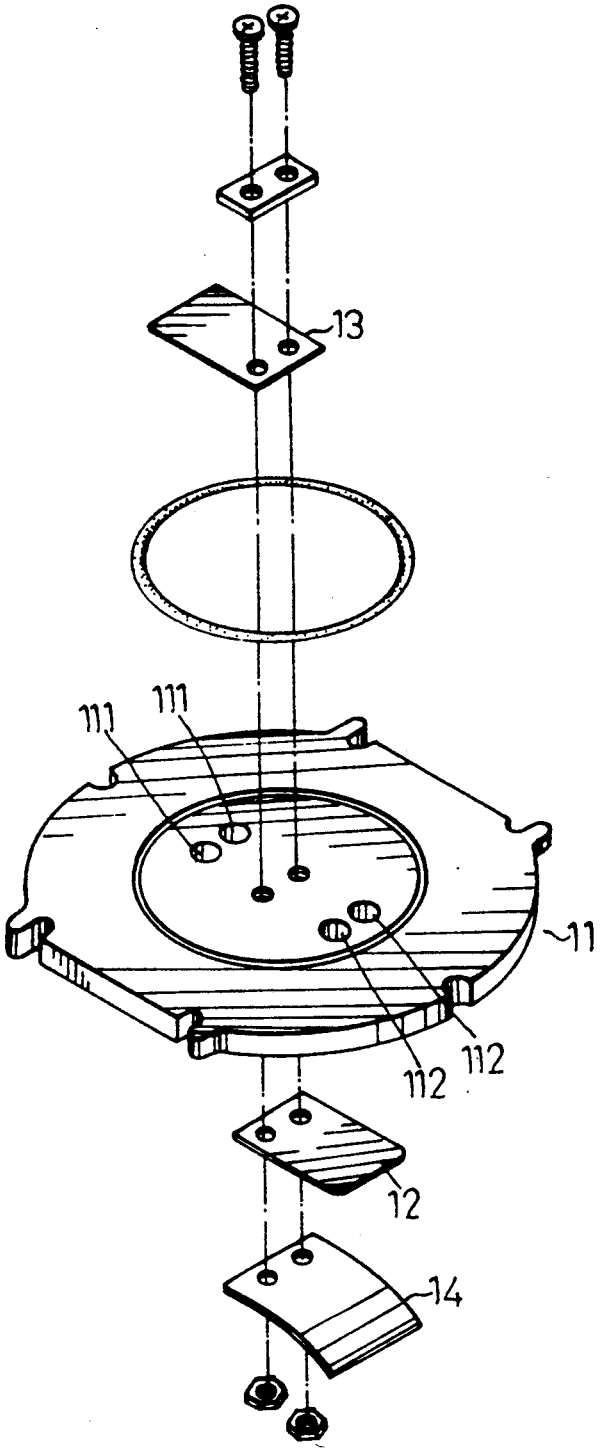
FIG. 1 PRIOR ART
FIG. 1 is an exploded view of a conventional valve assembly for a piston compressor.
Figure 2:
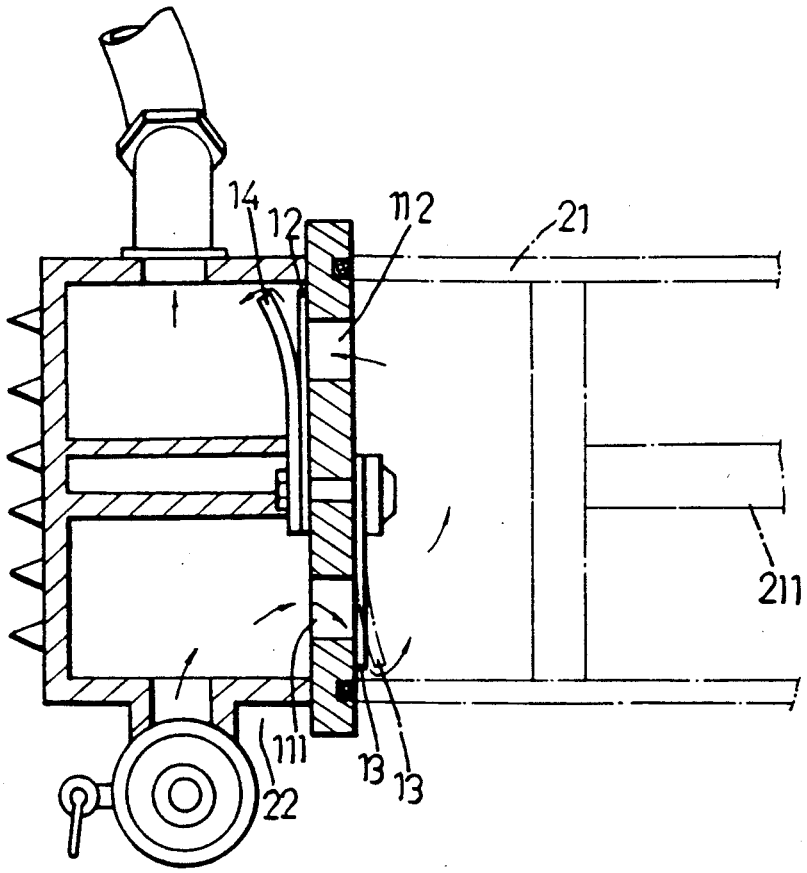
FIG. 2 PRIOR ART
FIG. 2 is a schematic view illustrating the operation of the conventional valve assembly shown in FIG. 1.
Figure 3:
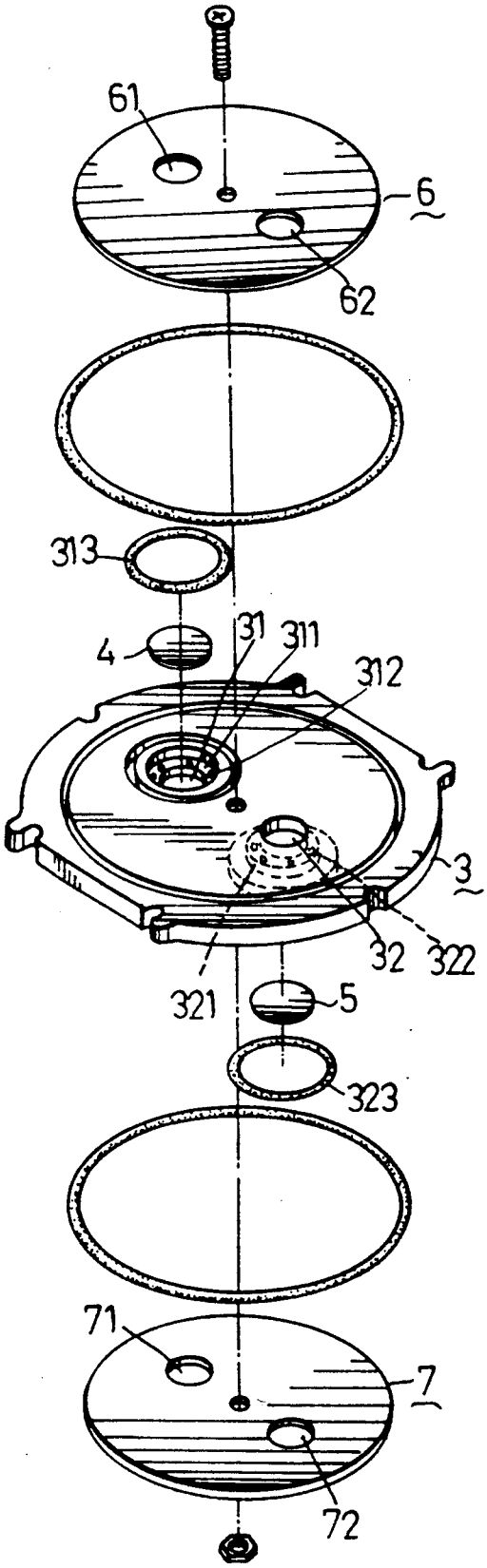
FIG. 3 is an exploded view of a valve assembly for a piston compressor according to this invention.
Figure 4:
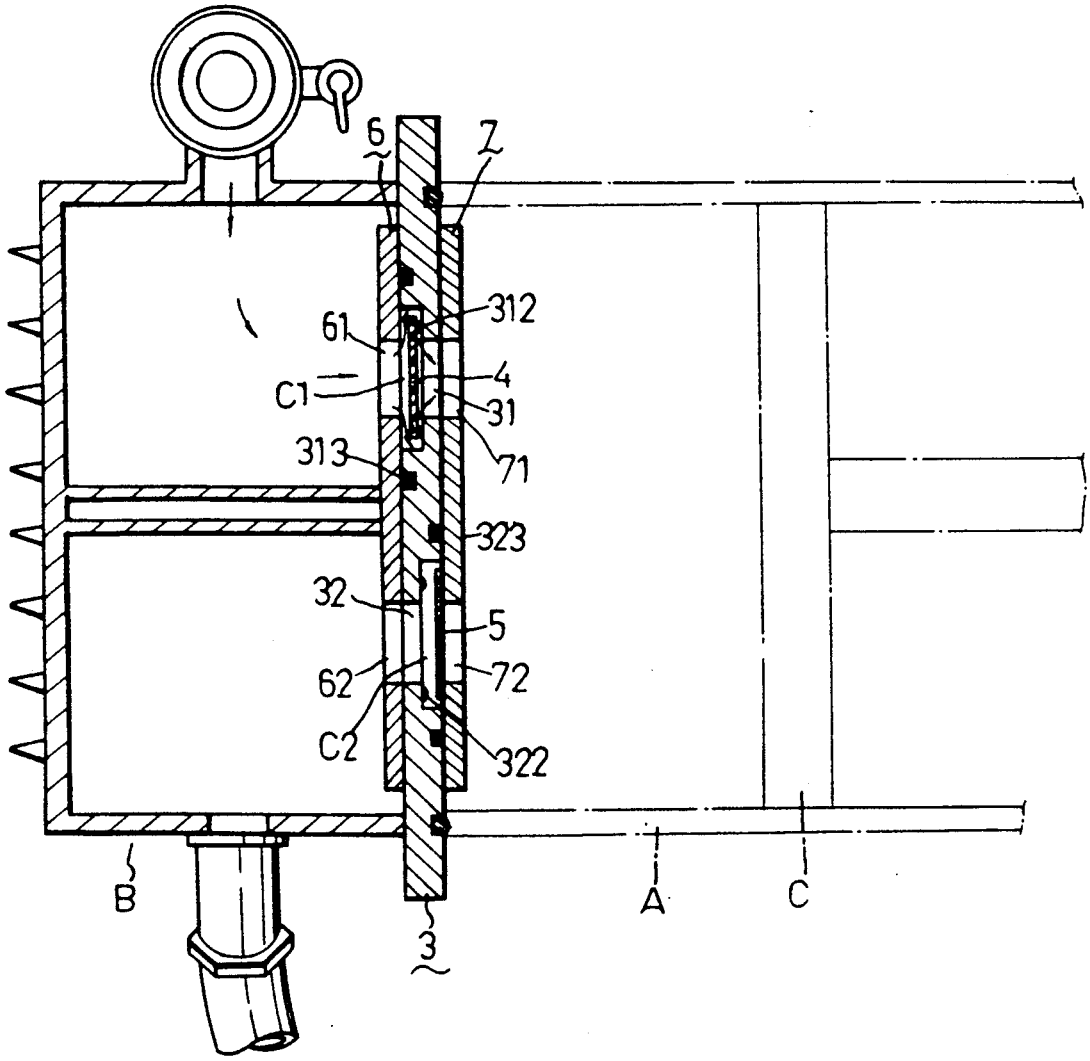
FIG. 4 is a schematic view illustrating the operation of the valve assembly during the suction stroke of the piston compressor in accordance with this invention.

Referring to FIGS. 3 and 4, a valve assembly for a piston compressor according to this invention includes a generally disc-shaped valve seat member 3, a substantially disc-shaped inlet valve 4, a substantially disc-shaped outlet valve 5, an outer retaining plate 6 and an inner retaining plate 7.

The valve seat member 3 has an inner end surface connected securely to a cylinder body (A), an outer end surface securely to a cylinder cover (B), an axially extending inlet hole 31 formed through the valve seat member 3, and an axially extending outlet hole 32 formed through the valve seat member 3. The inlet hole 31 has an increased-diameter end portion 311 formed in the outer end surface of the valve seat member 3, while the outlet hole 32 has an increased-diameter end portion 321 formed in the inner end surface of the valve seat member 3.

The outer retaining plate 6 and the inner retaining plate 7 are screwed coaxially to the valve seat member 3, so as to retain the inlet valve 4 and the outlet valve 5 on the valve seat member 3. Each of the outer retaining plate 6 and the inner retaining plate 7 has an inlet hole 61, 71 formed therethrough to communicate with the inlet hole 31 of the valve seat member 3, and an outlet hole 62, 72 formed therethrough to communicate with the outlet hole 32 of the valve seat member 3. The inlet holes 31, 61 and 71 constitute the inlet passage of the valve assembly, while the outlet holes 32, 62 and 72 constitute the outlet passage of the valve assembly. As illustrated, the enlarged end portion 311 of the inlet hole 31 of the valve seat member 3 defines an inlet chamber (C1) within which the inlet valve 4 is slidably disposed, while the enlarged end portion 321 of the outlet hole 32 of the valve seat member 3 defines an outlet chamber (C2) within which the outlet valve 5 is slidably disposed. The inlet chamber (C1) has an outer end wall, an inner end wall positioned between the outer end wall of the inlet chamber (C1) and the piston assembly (C) of the piston compressor. Similarly, the outlet chamber (C2) has an outer end wall, an inner end wall positioned between the outer end wall of the outlet chamber (C2) and the piston assembly (C) of the piston compressor.

Several inlet projections 312 extend from the inner end wall of the inlet chamber (C1), while several outlet projections 322 extend from the outer end wall of the outlet chamber (C2). An annular inlet-surrounding groove is formed in the outer end surface of the valve seat member 3 around the enlarged end portion 311 of the inlet hole 31, so as to receive a first O-ring 313 therein, thereby establishing an air-tight seal between the valve seat member 3 and the outer retaining plate 6 around the inlet hole 31 of the valve seat member 3. All of the inlet holes 31, 61 and 71 and the outlet holes 32, 62 and 72 are of the same diameter. The diameter of the inlet valve 4 is the same as that of the outlet valve 5 and is greater than that of the inlet holes 31, 61 and 71. An annular outlet-surrounding groove is formed in the inner end surface of the valve seat member 3 around the enlarged end portion 321 of the outlet hole 32, so as to receive a second O-ring 323 therein, thereby establishing an air-tight seal between the valve seat member 3 and the inner retaining plate 7, around the outlet hole 32.

In this embodiment, the inlet valve 4 and the outlet valve 5 are made of a rubber magnet, and the outer retaining plate 6 and the inner retaining plate 7 are made of a metal which can be attracted by the rubber magnet, so that the inlet valve 4 and the outlet valve 5 can close respectively and effectively the inlet hole 61 of the outer retaining plate 6 and the outlet hole 72 of the inner retaining plate 7.

When the piston assembly (C) moves away from the valve assembly during the suction stroke of the piston compressor, the inlet valve 4 and the outlet valve 5 are pushed by the gas outside the cylinder body (A) to move toward the piston assembly (C). As a result, the inlet valve 4 rests on the inlet projections 312, thus enabling gas to flow into the cylinder body (A), while the outlet valve 5 rests on the inner retaining plate 5 and closes the outlet hole 72 of the inner retaining plate 5.

Figure 5:
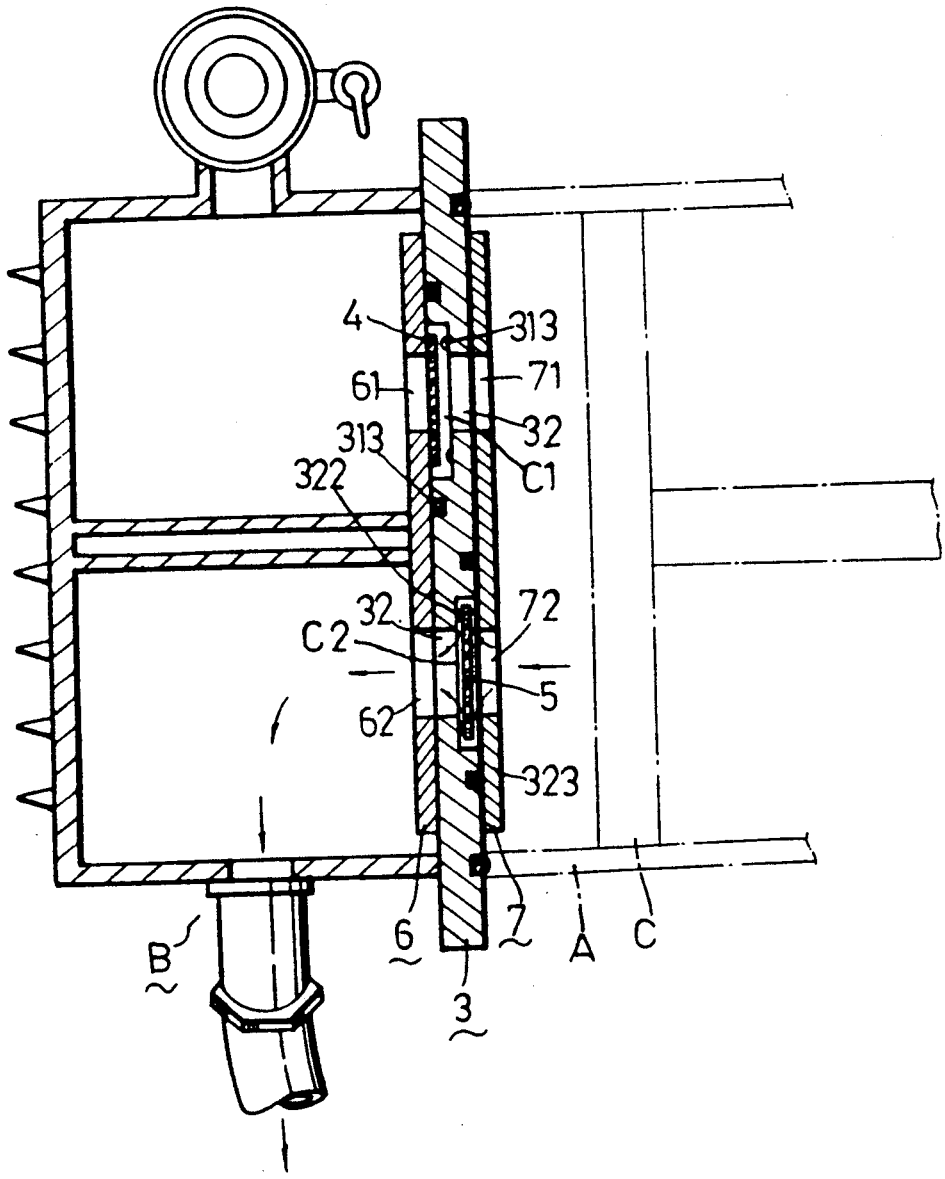
FIG. 5 is a schematic view illustrating the operation of the valve assembly during the compression stroke of the piston compressor in accordance with this invention.

Referring to FIG. 5, when the piston assembly (C) moves toward the valve assembly during the compression stroke of the piston compressor, the inlet valve 4 and the outlet valve 5 are pushed by the gas in the cylinder body (A) to move away from the piston assembly (C). As a result, the inlet valve 4 rests on the outer retaining plate 6 and closes the inlet hole 61 of the outer retaining plate 6, while the outlet valve 5 rests on the outlet projections 322, thus enabling gas to flow from the cylinder body (A).

Figure 6:
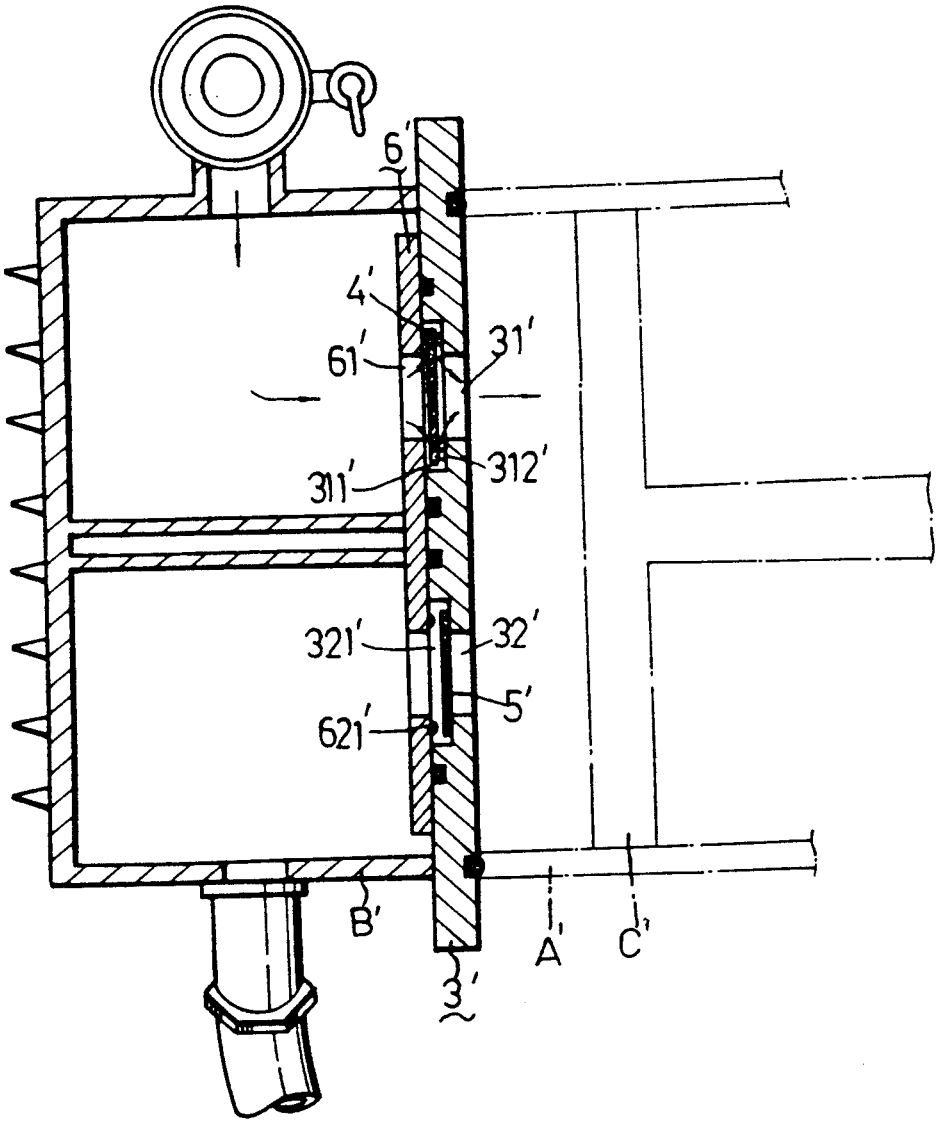
FIG. 6 is a view similar to FIG. 4, illustrating the operation of another embodiment of this invention during the suction stroke of the piston compressor.

FIG. 6 shows another embodiment of this invention which has a simplified construction. In this embodiment, the valve assembly includes a valve seat member 3', an inlet valve 4', an outlet valve 5', and an outer retaining plate 6'. The valve seat member 3' and the outer retaining plate 6' each have an inlet hole (31', 61') and an outlet hole (32', 62'). The inlet hole 31' and the outlet hole 32' of the valve seat member 3' each have an enlarged end portion (311' and 321') formed in the outer end surface of the valve seat member 3'. Several inlet projections 312' are provided on the valve seat member 3' in the same manner as that of the first embodiment. The outer retaining plate 6' includes several outlet projections 621' extending from the inner end surface thereof into the enlarged end portion 321' of the inlet hole 32' of the valve seat member 3'. The inlet valve 4' and the outlet valve 5' perform the same functions as those of the inlet valve 4 and the outlet valve 5 of the first embodiment.

With this invention thus explained, it is apparent that numerous modifications and variations can be made without departing from the scope and spirit of this invention. It is therefore intended that this invention be limited only as indicated in the appended claims.

I claim:

1. A valve assembly interposed between a cylinder body and a cylinder cover of a piston compressor in which a piston assembly is provided slidably in said cylinder body, said valve assembly having an inlet passage, an outlet passage, an inlet valve to open and close said inlet passage, and an outlet valve to open and close said outlet passage, said inlet passage having an increased-diameter inlet chamber formed in an intermediate portion thereof, said outlet passage having an increasing-diameter outlet chamber formed in an intermediate portion thereof, said inlet chamber including an outer end wall, an inner end wall positioned between said outer end wall of said inlet chamber and said piston assembly, and several inlet projections extending from said inner end wall of said inlet chamber, said outlet chamber including an outer end wall of said outlet chamber and said piston assembly, and several outlet projections extending from said outer end wall of said outlet chamber, said inlet valve being disposed slidably within said inlet chamber and having a diameter greater than that of said inlet passage, so as to rest on said outer end wall of said inlet chamber in a compression stroke, thereby closing said inlet passage, said outlet valve being disposed slidably within said outlet chamber and having a diameter greater than that of said outlet passage, so as to rest on said inner end wall of said outlet chamber in a suction stroke, thereby closing said outlet passage; whereby, said inlet valve rests on said inlet projections during the suction stroke so that gas can flow into said cylinder body through said inlet passage in the suction stroke; and whereby said outlet valve rests on said outlet projections in the compression stroke so that gas can flow from said cylinder body through said outlet passage;

a generally disc-shaped valve seat member including an outer end surface connected securely to said cylinder cover, an inner end surface connected securely to said cylinder body, an axially extending inlet hole formed through said valve seat member and having an increased-diameter end portion formed in said outer end surface of said valve seat member so as to form said inlet chamber, an annular inlet-surrounding groove formed in said outer end surface of said valve seat member around said inlet chamber, an axially extending outlet hole formed through said valve seat member and having an increased-diameter end portion formed in said inner end surface of said valve seat member so as to form said outlet chamber, and an annular outlet-surrounding groove formed in said inner end surface of said valve seat member around said outlet chamber;

an outer retaining plate, secured to said outer end surface of said valve seat member so as to retain said inlet valve within said inlet chamber, having an inlet hole formed through said outer retaining plate to communicate with said inlet hole of said valve seat member, and an outlet hole formed through said outer retaining plate to communicate with said outlet hole of said valve seat member;

an inner retaining plate, secured to said inner end surface of said valve seat member so as to retain said outlet valve within said outlet chamber, having an inlet hole formed through said inner retaining plate to communicate with said inlet hole of said valve seat member, and an outlet hole formed through said inner retaining plate to communicate with said outlet hole of said valve seat member, said inlet holes of said valve seat member, said outer retaining plate and said inner retaining plate constituting together said inlet passage, said outlet holes of said valve seat member, said outer retaining plate and said inner retaining plate constituting together said outlet passage;

a first O-ring receive within said inlet-surrounding groove of said valve seat member so as to establish an airtight seal between said valve seat member and said outer retaining plate around said inlet chamber; and a second O-ring received within said outlet-surrounding groove of said valve seat member so as to establish an airtight seal between said valve seat member and said inner retaining plate around said outlet chamber.

2. A valve assembly as claimed in claim 1, wherein said inlet valve and said outlet valve are made of a rubber magnet, and said inner and outer end walls of said inlet and outer chambers are made of a metal which said rubber magnets are attracted to.

* * * * *